US005928119A

United States Patent [19]

Dinkel

[11] Patent Number: 5,928,119

[45] Date of Patent: Jul. 27, 1999

[54] INCLINED PUSHUP DEVICE

[76] Inventor: Edward K. Dinkel, 530 Norwood Rd., Columbia, Pa. 17512

[21] Appl. No.: 09/054,248

[22] Filed: Apr. 2, 1998

[51] Int. Cl.[6] ..... A63B 26/00

[52] U.S. Cl. ..... 482/141; 482/907; 482/142

[58] Field of Search ..... 482/141, 142, 482/143, 140, 91, 907, 94, 95, 96, 35, 36, 37, 52; 182/152

[56] References Cited

U.S. PATENT DOCUMENTS

| | | | |
|---|---|---|---|
| 2,438,173 | 3/1948 | Johnson et al. | 182/152 |
| 3,006,643 | 10/1961 | Ryan | 482/142 |
| 3,547,435 | 12/1970 | Scott | 482/35 |
| 3,679,203 | 7/1972 | Grana | 482/142 |
| 4,316,608 | 2/1982 | Lundberg | 482/142 |
| 4,826,151 | 5/1989 | Nuredin | 482/141 |
| 5,112,043 | 5/1992 | Gilfillian, Jr. | 482/53 |
| 5,395,296 | 3/1995 | Webster et al. | 482/130 |

*Primary Examiner*—Richard J. Apley
*Assistant Examiner*—Justine R. Yu

[57] ABSTRACT

A new inclined pushup device for allowing persons with knee and back problems to safely perform pushups. The inventive device includes a base member. A pair of outer legs extend upwardly from the base member. A first pair of inner legs extending upwardly from the base member. An upper cross bar extends between the upper ends of the pair of outer legs and the first pair of inner legs. A second pair of inner legs extend upwardly from the base member. A lower cross bar is secured to upper ends of the second pair of inner legs. A pair of angularly disposed support bars have lower ends secured to the base member opposed from the first pair of inner legs. Upper ends of the support bars are secured to the upper cross bar. Intermediate portions of the support bars are secured to the lower cross bar.

7 Claims, 2 Drawing Sheets

18
16
26
22
12

16
18
26
22
12

INCLINED PUSHUP DEVICE

BACKGROUND OF THE INVENTION

1. Field of the Invention

The present invention relates to exercise devices and more particularly pertains to a new inclined pushup device for allowing persons with knee and back problems to safely perform pushups.

2. Description of the Prior Art

The use of exercise devices is known in the prior art. More specifically, exercise devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art exercise devices include U.S. Pat. No. 4,923,194 to Montgomery; U.S. Pat. No. 5,205,802 to Swisher; U.S. Pat. No. 4,850,589 to Block; U.S. Pat. No. 3,235,255 to Leflar; U.S. Pat. No. 2,788,971 to Berne; Pat. No. WO 93/10863 to Swisher; and Pat. No. WO 94/17864 to Agan.

While these devices fulfill their respective, particular objectives and requirements, the aforementioned patents do not disclose a new inclined pushup device. The inventive device includes a base member. A pair of outer legs extend upwardly from the base member. A first pair of inner legs extending upwardly from the base member. An upper cross bar extends between the upper ends of the pair of outer legs and the first pair of inner legs. A second pair of inner legs extend upwardly from the base member. A lower cross bar is secured to upper ends of the second pair of inner legs. A pair of angularly disposed support bars have lower ends secured to the base member opposed from the first pair of inner legs. Upper ends of the support bars are secured to the upper cross bar. Intermediate portions of the support bars are secured to the lower cross bar.

In these respects, the inclined pushup device according to the present invention substantially departs from the conventional concepts and designs of the prior art, and in so doing provides an apparatus primarily developed for the purpose of allowing persons with knee and back problems to safely perform pushups.

SUMMARY OF THE INVENTION

In view of the foregoing disadvantages inherent in the known types of exercise devices now present in the prior art, the present invention provides a new inclined pushup device construction wherein the same can be utilized for allowing persons with knee and back problems to safely perform pushups.

The general purpose of the present invention, which will be described subsequently in greater detail, is to provide a new inclined pushup device apparatus and method which has many of the advantages of the exercise devices mentioned heretofore and many novel features that result in a new inclined pushup device which is not anticipated, rendered obvious, suggested, or even implied by any of the prior art exercise devices, either alone or in any combination thereof.

To attain this, the present invention generally comprises a base member having a generally rectangular configuration. The base member includes opposed short end pipes and opposed long side pipes. The base member includes a central pipe extending between the side pipes. A pair outer legs extend upwardly from the base member in an orthogonal relationship with respect thereto. The outer legs are secured to the opposed long side pipes of the base member inwardly of one of the short end pipes thereof. A first pair of inner legs extend upwardly from the base member at a less than ninety degree angle with respect thereto. The first pair of inner legs are secured to the short end pipe of the base member adjacent to the pair of outer legs. Upper ends of the first pair of inner legs are at a height equal to upper ends of the outer legs. An upper cross bar extends between the upper ends of the pair of outer legs and the first pair of inner legs. A second pair of inner legs extend upwardly from the base member in an orthogonal relationship with respect thereto. The second pair of inner legs are secured to the central pipe of the base member. The second pair of inner legs have a length about half of a length of the pair of outer legs. A lower cross bar is secured to upper ends of the second pair of inner legs. A pair of angularly disposed support bars are provided having lower ends secured to the short end pipe of the base member opposed from the first pair of inner legs. Upper ends of the support bars are secured to the upper cross bar. Intermediate portions of the support bars are secured to the lower cross bar.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new inclined pushup device apparatus and method which has many of the advantages of the exercise devices mentioned heretofore and many novel features that result in a new inclined pushup device which is not anticipated, rendered obvious, suggested, or even implied by any of the prior art exercise devices, either alone or in any combination thereof.

It is another object of the present invention to provide a new inclined pushup device which may be easily and efficiently manufactured and marketed.

It is a further object of the present invention to provide a new inclined pushup device which is of a durable and reliable construction.

An even further object of the present invention is to provide a new inclined pushup device which is susceptible of a low cost of manufacture with regard to both materials and labor, and which accordingly is then susceptible of low prices of sale to the consuming public, thereby making such inclined pushup device economically available to the buying public.

Still yet another object of the present invention is to provide a new inclined pushup device which provides in the apparatuses and methods of the prior art some of the advantages thereof, while simultaneously overcoming some of the disadvantages normally associated therewith.

Still another object of the present invention is to provide a new inclined pushup device for allowing persons with knee and back problems to safely perform pushups.

Yet another object of the present invention is to provide a new inclined pushup device which includes a base member. A pair of outer legs extend upwardly from the base member. A first pair of inner legs extending upwardly from the base member. An upper cross bar extends between the upper ends of the pair of outer legs and the first pair of inner legs. A second pair of inner legs extend upwardly from the base member. A lower cross bar is secured to upper ends of the second pair of inner legs. A pair of angularly disposed support bars have lower ends secured to the base member opposed from the first pair of inner legs. Upper ends of the support bars are secured to the upper cross bar. Intermediate portions of the support bars are secured to the lower cross bar.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
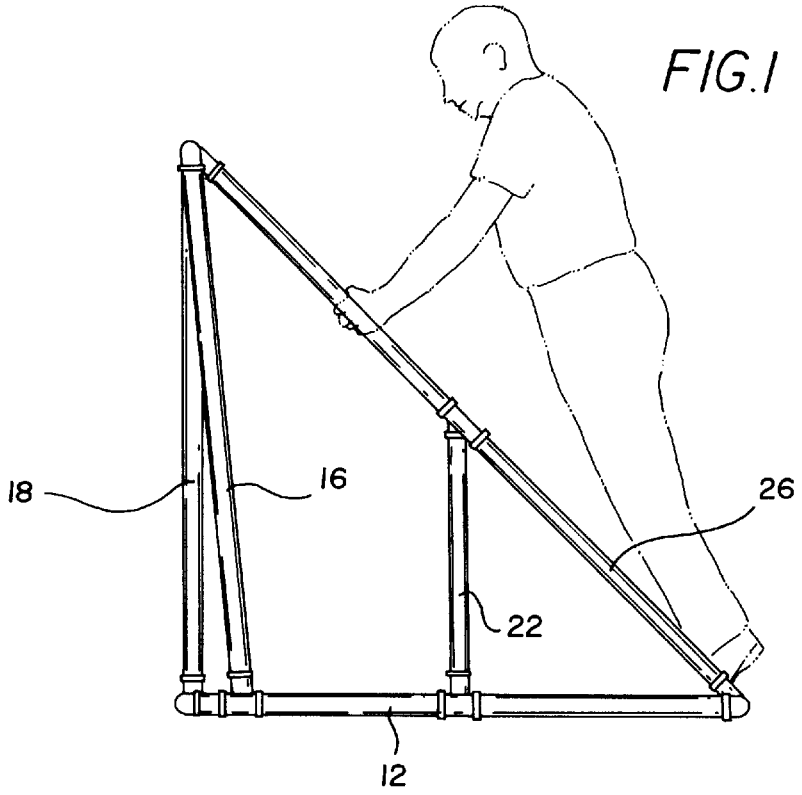
FIG. 1 is a side view of a new inclined pushup device according to the present invention.
Figure 2:
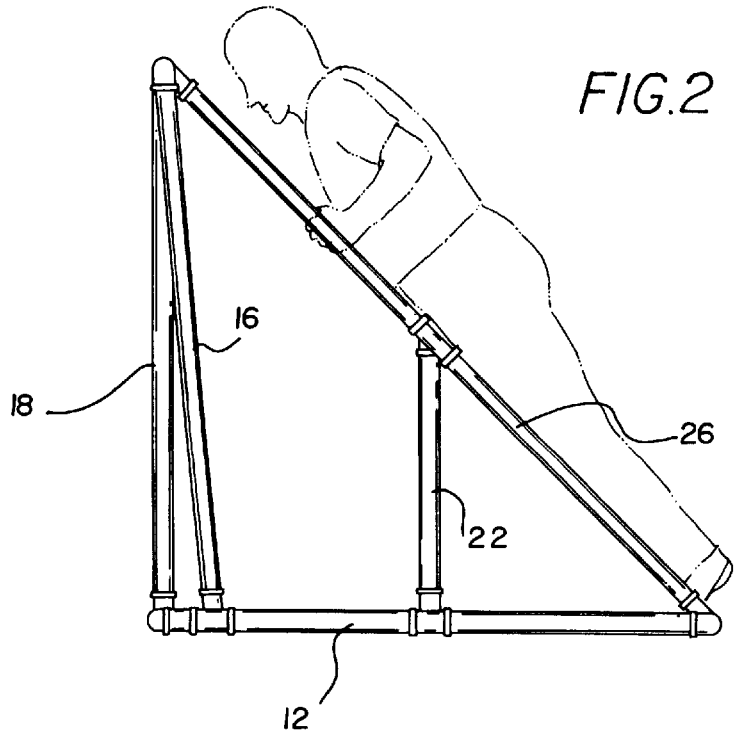
FIG. 2 is a side view of the present invention illustrated in use.
Figure 3:
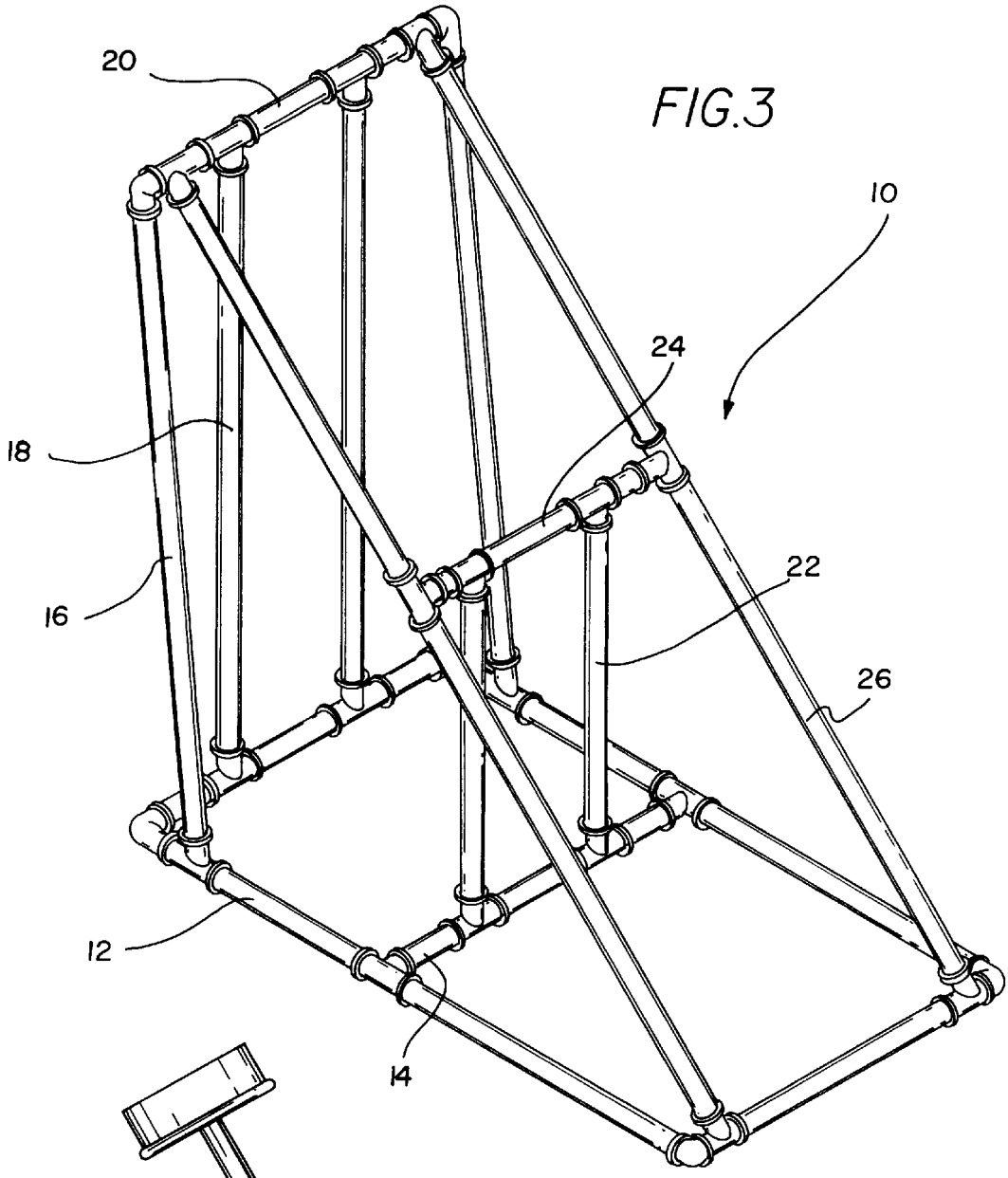
FIG. 3 is a perspective view of the present invention.
Figure 4:
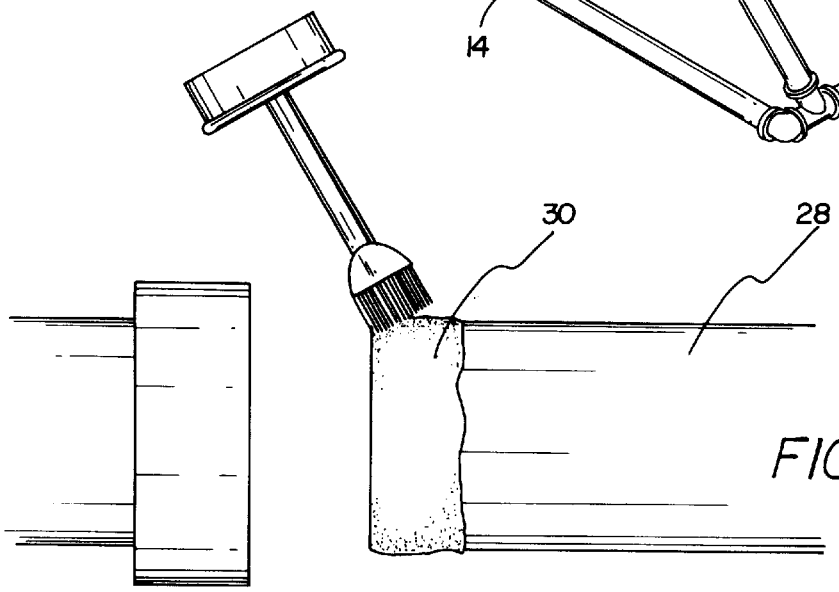
FIG. 4 is a side view of the present invention illustrating attachment of individual pipes.

With reference now to the drawings, and in particular to FIGS. 1 through 4 thereof, a new inclined pushup device embodying the principles and concepts of the present invention and generally designated by the reference numeral 10 will be described.

As best illustrated in FIGS. 1 through 4, the inclined pushup device 10 comprises a base member 12 having a generally rectangular configuration. The base member 12 includes opposed short end pipes and opposed long side pipes. The base member 12 includes a central pipe 14 extending between the side pipes.

A pair of outer legs 16 extend upwardly from the base member 12 in an orthogonal relationship with respect thereto. The outer legs 16 are secured to the opposed long side pipes of the base member 12 inwardly of one of the short end pipes thereof.

A first pair of inner legs 18 extend upwardly from the base member 12 at a less than ninety degree angle with respect thereto. The first pair of inner legs 18 are secured to the short end pipe of the base member 12 adjacent to the pair of outer legs 16. Upper ends of the first pair of inner legs 18 are at a height equal to upper ends of the outer legs 16.

An upper cross bar 20 extends between the upper ends of the pair of outer legs 16 and the first pair of inner legs 18.

A second pair of inner legs 22 extend upwardly from the base member 12 in an orthogonal relationship with respect thereto. The second pair of inner legs 22 are secured to the central pipe 14 of the base member 12. The second pair of inner legs 22 have a length about half of a length of the pair of outer legs 16.

A lower cross bar 24 is secured to upper ends of the second pair of inner legs 22.

A pair of angularly disposed support bars 26 are provided having lower ends secured to the short end pipe of the base member 12 opposed from the first pair of inner legs 18. Upper ends of the support bars 26 are secured to the upper cross bar 20. Intermediate portions of the support bars 26 are secured to the lower cross bar 24.

The present invention is a framework constructed of polyvinylchloride plastic tubing 28 that is interconnected by T-shaped and L-shaped connectors. The framework is secured together using pipe glue 30.

In use, the present invention would build, strengthen, and rehabilitate a variety of body muscles. The present invention is especially intended as an exercise device for individuals with knee and back limitations. For use, an individual would stand on front of the device 10 and extend the arms straight out to grasp the support 32 bars 26, then bend the elbows so that the midsection touches the I; lower cross bar 24. The user would then attempt to straighten out their arms by pushing outwardly against the support bars 26 thereby completing a pushup repetition.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new inclined pushup device for allowing persons with knee and back problems to safely perform pushups comprising, in combination:

a base member having a generally rectangular configuration, the base member including opposed short end pipes and opposed long side pipes, the base member including a central pipe extending between the side pipes;

a pair of outer legs extending upwardly from the base member in an orthogonal relationship with respect thereto, the outer legs secured to the opposed long side pipes of the base member inwardly of one of the short end pipes thereof;

a first pair of inner legs extending upwardly from the base member at a less than ninety degree angle with respect thereto, the first pair of inner legs secured to the short end pipe of the base member adjacent to the pair of outer legs, upper ends of the first pair of inner legs being at a height equal to upper ends of the outer legs;

an upper cross bar extending between the upper ends of the pair of outer legs and the first pair of inner legs;

a second pair of inner legs extending upwardly from the base member in an orthogonal relationship with respect thereto, the second pair of inner legs secured to the central pipe of the base member, the second pair of inner legs having a length about half of a length of the pair of outer legs;

a lower cross bar secured to upper ends of the second pair of inner legs; and a pair of angularly disposed support bars having lower ends secured to the short end pipe of the base member opposed from the first pair of inner legs, upper ends of the support bars secured to the upper cross bar, intermediate portions of the support bars secured to the lower cross bar.

2. A new inclined pushup device for allowing persons with knee and back problems to safely perform pushups comprising, in combination:

a base member;

a pair of outer legs extending upwardly from the base member in an orthogonal relationship with respect thereto;

a first pair of inner legs extending upwardly from the base member;

an upper cross bar extending between the upper ends of the pair of outer legs and the first pair of inner legs;

a second pair of inner legs extending upwardly from the base member;

a lower cross bar secured to upper ends of the second pair of inner legs; and a pair of angularly disposed support bars having lower ends secured to the base member opposed from the first pair of inner legs, upper ends of the support bars secured to the upper cross bar, intermediate portions of the support bars secured to the lower cross bar.

3. The inclined pushup device as set forth in claim 2 wherein the base member includes opposed short end pipes and opposed long side pipes, the base member including a central pipe extending between the side pipes.

4. The inclined pushup device as set forth in claim 3 wherein the outer legs are secured to the opposed long side pipes of the base member inwardly of one of the short end pipes thereof.

5. The inclined pushup device as set forth in claim 4 wherein the first pair of inner legs extend upwardly from the base member at a less than ninety degree angle with respect thereto.

6. The inclined pushup device as set forth in claim 5 wherein the first pair of inner legs are secured to the short end pipe of the base member adjacent to the pair of outer legs, upper ends of the first pair of inner legs being at a height equal to upper ends of the outer legs.

7. The inclined pushup device as set forth in claim 6 wherein the second pair of inner legs are secured to the central pipe of the base member, the second pair of inner legs having a length about half of a length of the pair of outer legs.

* * * * *